US005538692A

United States Patent [19]

Joannou

[11] Patent Number: 5,538,692

[45] Date of Patent: Jul. 23, 1996

[54] IONIZING TYPE AIR CLEANER

[76] Inventor: Constantinos J. Joannou, 49 Mill Street, Apt. 4, Carleton Place, Ontario, Canada, K7C 1T6

[21] Appl. No.: 238,532

[22] Filed: May 5, 1994

[30] Foreign Application Priority Data

Oct. 10, 1993 [CA] Canada ..... 2108539

[51] Int. Cl.[6] ..... A62B 7/08

[52] U.S. Cl. ..... 422/121; 96/66; 96/97; 96/99; 422/120

[58] Field of Search ..... 422/4, 22, 120, 422/121; 96/97, 98, 99, 88, 68, 66; 55/360

[56] References Cited

U.S. PATENT DOCUMENTS

| | | | |
|---|---|---|---|
| 3,217,470 | 11/1965 | Omohundro | 422/120 X |
| 3,581,462 | 6/1971 | Stump | 96/66 X |
| 3,654,534 | 4/1972 | Fischer | 422/4 X |
| 4,049,400 | 9/1977 | Bennett et al. | 422/4 X |
| 4,376,642 | 3/1983 | Verity | 422/121 X |
| 4,391,773 | 7/1983 | Flanagan | 422/121 X |
| 5,024,685 | 6/1991 | Török et al. | 96/66 X |

*Primary Examiner*—James C. Housel
*Assistant Examiner*—Krisanne M. Thornton

[57] ABSTRACT

An ionizing type air cleaner having ionizing needle(s) and a collector element. The collector element is made of either many conducting elements with isolating resistors or a single high resistivity element in order to prevent electric shock when touched.

4 Claims, 3 Drawing Sheets

IONIZING TYPE AIR CLEANER

FIELD OF THE INVENTION

This invention relates to a class of air cleaners using the ionizing principle for collecting dust. More particularly, it concerns devices having ionizing electrodes that are exposed and may tend to transmit mild electric shocks to persons who contact the device.

BACKGROUND OF THE INVENTION

Ionizing type air cleaners of the type addressed by the invention consist of a charge source, which may be in the form of negatively charged ionizing needles and a positively charged collector located near the needles.

Customarily, the collector is a good conductor of electricity and presents a large surface to the surrounding air. The ionizing needles emit electrons which negatively charge the surrounding air molecules and dust particles contained therein. The negatively charged dust particles are then attracted to the positively charged collector where they are collected. The voltages involved in these ionizing air cleaners are of the order of 10–20 kilovolts.

There is a drawback in the present type of air cleaners in that their collectors operate at relatively high voltages and have enough electrical capacitance due to their large size, to store sufficient charge to cause an electric shock to anyone that touches them. This condition occurs even if the collectors are isolated from the power supply by high resistances.

It is an object of the present invention to provide an ionizing type air cleaner which does not have the above described drawback and without sacrificing the air cleaner's performance.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The present invention comprises an ionizing type air cleaner having a negatively charged ionizing source, and a positively charged dust collector with a dust collecting surface accessible to human contact the collector having discharge limiting means to prevent delivery from capacitively stored charge present on the collector surface of a discomforting shock to a user who contacts such collector surface. The dust collector is constructed as an assembly with many conducting segments spaced from each other by insulating means whereby the capacitance of the assembly, and its capacity to transmit a shock to a user, is reduced. Alternately, the dust collector may comprise a high resistivity material which performs equivalently.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
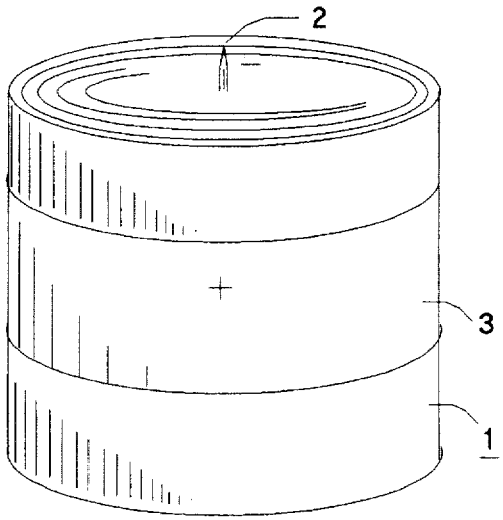
Fig. 1 (PRIOR ART)
FIG. 1 shows a typical ionizing air cleaner with ionizing needle and collector.
Figure 2:
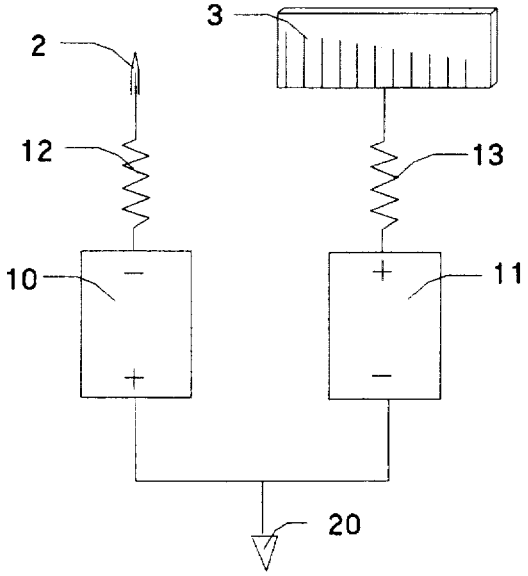
Fig. 2 (PRIOR ART)
FIG. 2 is a wiring diagram of FIG. 1.

In FIGS. 1 and 2, a typical ionizing air cleaner 1 is depicted. An ionizing needle 2 is connected to a negative terminal of high voltage power supply 10 via a high value resistor 12. A collector 3 incorporating conducting material is connected to the positive terminal of high voltage power supply 11 via another high value resistor 13. A ground 20 is present intermediate between these two power supplies. Collectively, the two power supplies 10, 11, provide a voltage differential between the ionizing needle 2 and collector 3.

In this typical system, both the ionizing needle 2 and the collector 3 are exposed. Because of the high voltage at the collector 3, and the collector's normal capacitance, if a person touches the collector 3, he or she will receive a mild electric shock. This shock is result of the charge accumulated on the collector 3 discharging abruptly onto the person's hand. The ionizing needle 2 does not present such a hazard because it is isolated by resistance 12, and because it is small in size it does not have sufficient capacitance to store any appreciable amount of electric charge.

Figure 3:
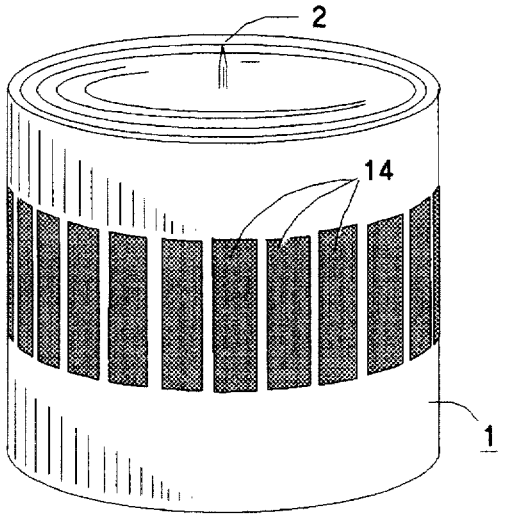
FIG. 3 shows an ionizing air cleaner with a collector made up of many small segments.

In order to minimize or eliminate the shock hazard mentioned above, the present invention utilizes two possible, equivalent alternatives. One alternative (see FIG. 3 and 4), is to construct the collector 3 of many small conducting segments 14 spaced from each other by insulative materials 20. Each segment 14 has only a small electrical capacitance and is connected to power supply 11 by individual high value resistors 15. In this way, a person touching the collector 3 will only touch a few segments 14 of the collector 3 at a time. Each segment 14, because of its very small capacitance, can discharge only a very small current. In this way, the shock hazard is minimized.

Figure 5:
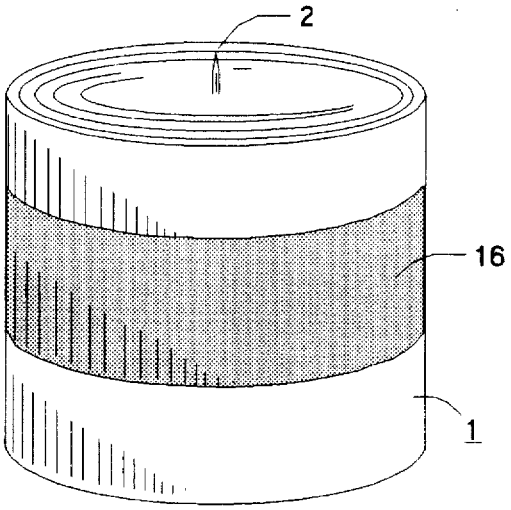
FIG. 5 shows an ionizing air cleaner with high resistivity collector.

Another equivalent alternative (see FIGS. 5 and 6), is to make the collector 3 of a highly resistive material 16, having a resistivity say of the order of $10^6$–$10^{12}$ ohms per cubic centimeter. Such a material is not totally non-conductive. An example of a material is POLYTRON (TM) made by the B. F. Goodrich Company, a polymer plastic containing components to render it slightly conductive. This arrangement will prevent a discomforting discharge occurring between the collector material 16 and the hand of the person touching it because the high resistance material 16 will prevent any significant amount of charge from flowing abruptly from the collector to the person's hand. At the same time, performance of the device will not be significantly affected because the amount of current normally passing through the collector 16 is very small, of the order of a few microamperes. Therefore, the voltage potential drop (I×R drop) at the surface of the collector will be minimal.

Figure 4:
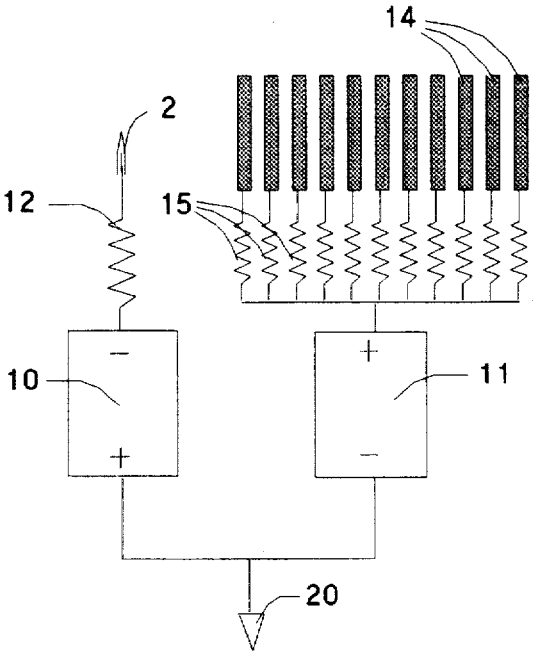
FIG. 4 is a wiring diagram of FIG. 3.
Figure 6:
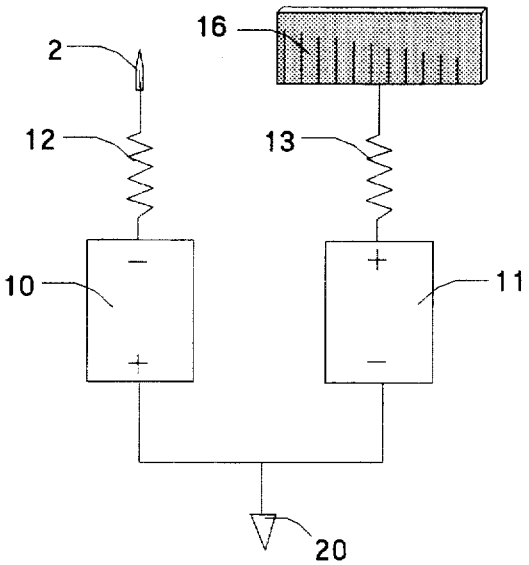
FIG. 6 is a wiring diagram of FIG. 5.
Figure 7:
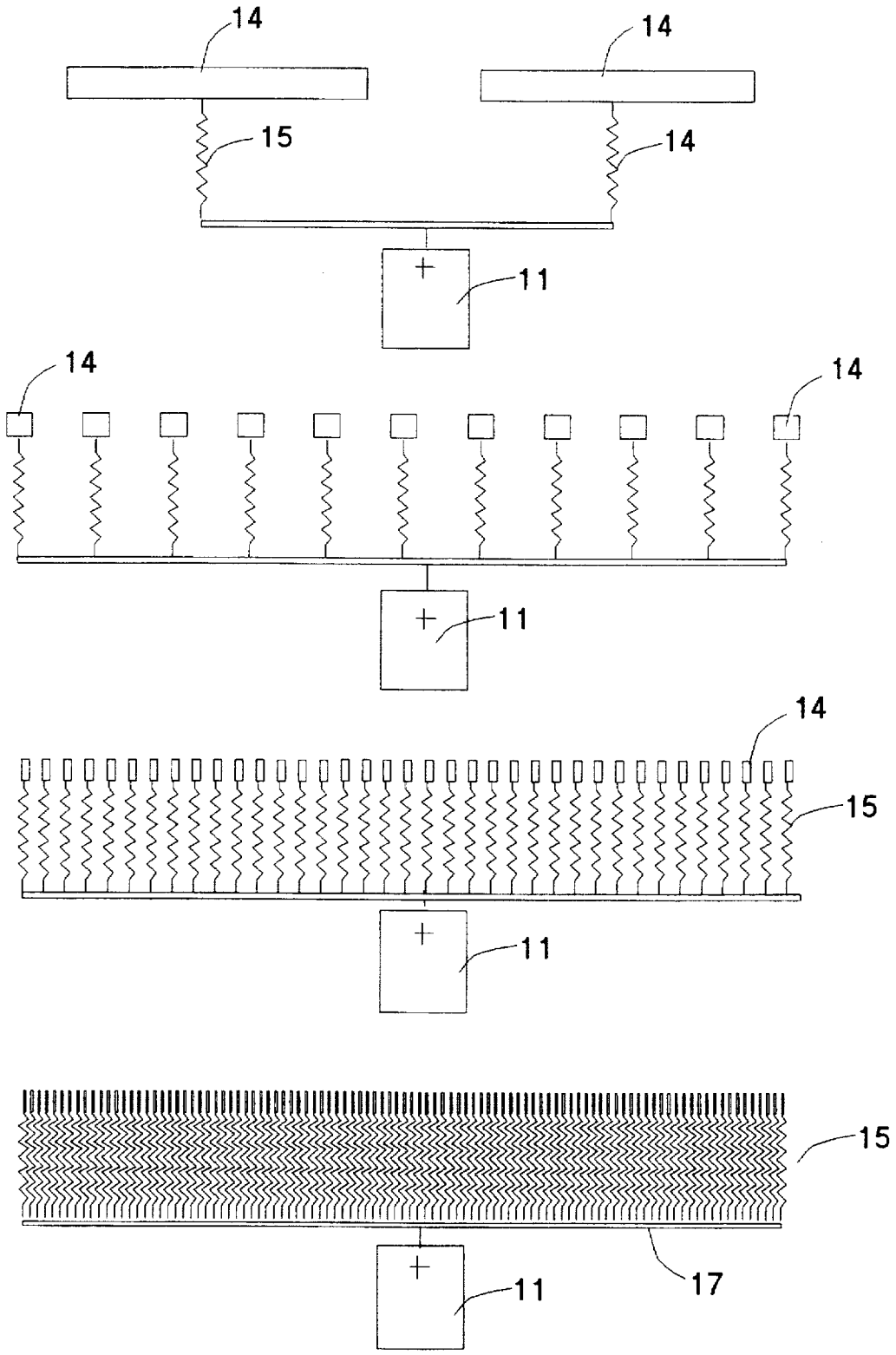
FIG. 7 shows a progression of circuits from that of FIG. 4 to that of FIG. 6.

FIG. 7 shows a series of three circuits showing a progression from that of FIG. 4 to that of FIG. 6. FIG. 7 shows that, at the limit, a highly resistive but nevertheless conductive collector 16 is virtually equivalent to a multitude of discrete conducting segments 14 isolated by individual resistors 15.

Figure 8:
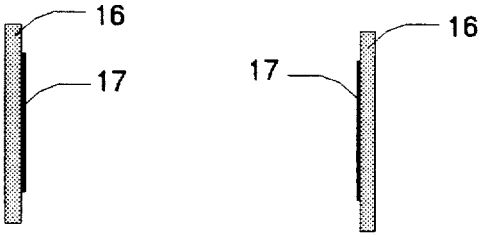
FIG. 8 shows a cross-sectional view of a collector of the type of FIG. 5 with a conducting substrate.
Figure 9:
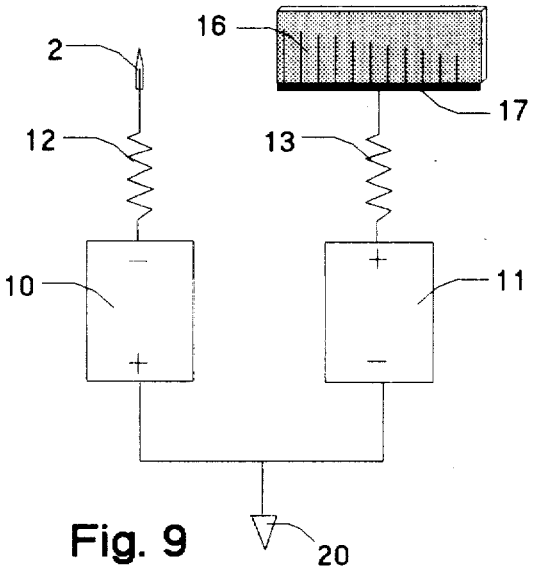
FIG. 9 is a schematic wiring diagram of FIG. 8.

FIG. 8 also shows an added conducting substrate 17 to the high resistivity collector 16 to function as an electrode. Substrate 17 may consist of a metal plate or a conducting coating. High voltage to the collector is provided via substrate 17. The purpose of the conducting substrate is to insure that various exposed parts of the surface of high resistivity collector 16 have the same distance to the high voltage input electrode (i.e. substrate 17) so that the I×R voltage drop mentioned above will be more even across the exposed surface which is backed by the substrate electrode 17.

If a conducting substrate is not used, the connection to the high voltage power supply will be at one point on the collector. This will have a great variation in distance between points on the exposed surface of collector 16 and, therefore, the furthest points will have higher I×R drop than the closest points. This will have the effect of having higher surface potential where the I×R drop is less than where the I×R drop is greater. The end result will be that the higher potential points will collect dust more efficiently than that lower potential points. By adding the conductive substrate 17 the air cleaner will be more efficient and collect dust more evenly.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed as follows:

1. An ionizing type air cleaner unit for removing dust from air comprising:

(a) a negative ion source positioned to produce ionization within air outwardly surrounding said source and thereby ionization of the dust contained within such air;

(b) a collector operatively connected to said negative ion source for collecting negative ions on a dust collecting exterior collector surface having portions that are exposed to said surrounding air and accessible to human contact, said exposed portions of said exterior collector surface being resistively connected to each other through resistive means positioned beneath said dust collecting exterior collector surface; and (c) a power supply providing a high voltage differential between said negative ion source and said collector to thereby establish the negative ion source with an ionizing potential below ground potential, and the collector with a positive, dust-collecting electrical charge that is above ground potential, said collector being provided on its surface with an electrical charge at a sufficient voltage potential to attract dust, and said resistive means acting as discharge limiting means that prevents delivery of a discomforting quantity of capacitively stored charge present on non-contacted portions of the collector surface to a grounded user who contacts a contacted portion of the collector surface.

2. An ionizing type air cleaner as in claim 1 wherein said collector comprises a plurality of conducting elements located on the collector surface and carrying said electrical charge, said conducting elements being spaced separately from each other by an electrically insulating material, each of said conducting elements being connected to said power supply via individual high value resistors which constitute said resistive means, each of such resistors being of a value that, upon contact of a conducting element by said user, the capacitance associated with such conducting element on the collector surface due to the isolation from other conducting elements provided by said resistors is not sufficient to deliver a quantity of charge that will cause a discomforting shock to a user who touches said conducting element.

3. An ionizing type air cleaner unit for removing dust from air comprising:

(a) a negative ion source positioned to produce ionization within air outwardly surrounding said source and thereby ionization of the dust contained within such air;

(b) a collector for collecting negative ions on a dust collecting exterior collector surface having portions that are exposed to said surrounding air and accessible to human contact, said exposed portions of said exterior collector surface being resistively connected to each other; and (c) a power supply providing a high voltage differential between said negative ion source and said collector to thereby establish the negative ion source with an ionizing potential below ground potential, and the collector with a positive, dust-collecting electrical charge that is above ground potential, said collector being provided on its exterior collector surface with an electrical charge at a sufficient voltage potential to attract dust, and being composed of a highly resistive, but not totally non-conductive collector material to provide said resistive connection, said resistive connection acting as discharge limiting means that prevents delivery of a discomforting quantity of capacitively stored charge present on non-contacted portions of the collector surface to a grounded user who contacts a contacted portion of the collector surface.

4. An air cleaner as in claim 3 wherein the collector comprises a substrate electrode surface located beneath an associated portion of said exterior collector surface with said resistive collector material positioned therebetween, such substrate electrode surface being sufficiently conductive to serve as a charge-source and provide the collector surface with a substantially constant voltage potential over the associated portion of the area of such surface.

* * * * *